US007028408B2

(12) United States Patent
Diamond

(10) Patent No.: US 7,028,408 B2
(45) Date of Patent: Apr. 18, 2006

(54) ARTIST SHADING TOOL, GUIDE, AND DRAWING SURFACE IN A METALPOINT DRAWING SYSTEM

(76) Inventor: Mitchell S. Diamond, 3540 Bedford Ave., Brooklyn, NY (US) 11210

( * ) Notice: Subject to any disclaimer, the term of this patent is extended or adjusted under 35 U.S.C. 154(b) by 0 days.

(21) Appl. No.: 10/839,682

(22) Filed: May 4, 2004

(65) Prior Publication Data

US 2005/0246907 A1 Nov. 10, 2005

(51) Int. Cl.
*B43L 13/00* (2006.01)

(52) U.S. Cl. ..... 33/18.2; 33/18.1

(58) Field of Classification Search ..... 33/18.2, 33/18.1

See application file for complete search history.

(56) References Cited

U.S. PATENT DOCUMENTS

| | | | | | |
|---|---|---|---|---|---|
| 2,298,555 | A | * | 10/1942 | Fargo | 401/93 |
| 2,536,657 | A | * | 1/1951 | Reese | 428/141 |
| 2,851,774 | A | * | 9/1958 | Bronner | 30/164.9 |
| 3,361,516 | A | * | 1/1968 | Rigondaud | 401/292 |
| 4,183,990 | A | * | 1/1980 | Uchida et al. | 428/212 |
| 4,531,853 | A | * | 7/1985 | Hirabayashi et al. | 401/265 |
| 6,123,794 | A | * | 9/2000 | Saff | 156/230 |

OTHER PUBLICATIONS

Matthews-Berenson, Margaret, "The Light Touch", American Artis, Spring 2004, pp. 1-3.*
Silverpoint Drawing Complete, "Catalog of Silverpoint Drawing & Supplies", www.silverpointweb.com, Feb. 7, 2003, pp. 1-3.*
Silverpoint Drawing Complete, "Overview and History of Silverpoint Drawing", www.silverpointweb.com, Mar. 2002, pp. 1-3.*
Shechter, Laura, "Silverpoint and Meticulous Drawing", Lecture to the National Arts Club, Biddington's Art Gallery, Dec. 19, 2000, pp. 1-7.*
Doherty, Stephen, "The Shimmer of Silverpoint Drawings", American Artist, Aug. 2000, pp. 1-5.*
Harvard University Art Museums-Fogg Art Museum, "A Drawing Glossary", 1996-1997, pp. 6, 9-12.*

* cited by examiner

*Primary Examiner*—Diego Gutierrez
*Assistant Examiner*—Amy R. Cohen
(74) *Attorney, Agent, or Firm*—Frommer Lawrence & Haug LLP; Marilyn Matthes Brogan, Esq.

(57) ABSTRACT

A metalpoint drawing system is provided. The system may include a drawing surface having a sheet of translucent paper with a coating substance applied thereto. The coating substance may be a correction fluid. The system may also include a tool for use by an artist for creating a metalpoint drawing on the drawing surface. The tool may include a holder and a variable length flexible stylus held by the holder and an associated shading guide.

20 Claims, 14 Drawing Sheets

ARTIST SHADING TOOL, GUIDE, AND DRAWING SURFACE IN A METALPOINT DRAWING SYSTEM

BACKGROUND OF THE INVENTION

1. Field of the Invention

The present invention is directed to an item or items utilized in a metalpoint drawing system. More particularly, the present invention is directed to a tool, a shading guide, and/or a prepared drawing surface utilized in the metalpoint drawing system.

2. Description of Related Art

Typically, metalpoint drawing techniques involve the use of a drawing instrument by an artist on a prepared drawing surface. Such drawing instrument may include a rigid silver stylus and such drawing surface may be prepared by applying a coating, such as a so-called gesso or Chinese white coating, to an opaque or substantially opaque sheet of drawing paper, board, carrier, or the like intended to abrade the stylus leaving an indelible mark on the drawing surface.

The use of such rigid stylus and the drawing surface prepared upon the opaque or substantially opaque material may limit the gamut or range of shading an artist may achieve in the drawing. In order to overcome the gamut limits and achieve a wider range of shading, the artist would wash the drawing with a dark or light wash as needed. For instance and as shown in FIG. 1(*a*), diagram 10 represents a gamut or range of tones 20–70 which may be produced by a metal stylus of the present invention on a prepared drawing surface. Tone 80 represents the base coating and the lightest tone. Conventional rigid styli may produce tones 50 through 70 when applied to the prepared drawing surface. In order to obtain tones 20 through 40 or smoother transitional tones, an artist would have to enhance the drawing using a tinted wash or other agents such as graphite.

As a result, in order to achieve a desired subtlety and/or wide range of shading, the artist may need to perform one or more enhancing or washing steps.

SUMMARY OF THE INVENTION

In an aspect of the invention, a tool for use by an artist for creating a metalpoint drawing on a prepared drawing surface is provided. The tool may comprise a holder and a variable length flexible stylus held by the holder.

In another aspect of the invention, a drawing surface for use by an artist using a metal stylus in a metalpoint drawing is provided. The surface may comprise a sheet of translucent paper having a coating substance applied thereto. Such coating may be a correction fluid.

In yet another aspect of the invention, a metalpoint drawing system is provided. The system may comprise a drawing surface having a sheet of translucent paper with a coating substance applied thereto, and a tool for use by an artist for creating a metalpoint drawing on the drawing surface. The tool may include a holder and a variable length flexible stylus held by the holder. The coating substance abrades the stylus creating the marks on the drawing surface.

In yet another aspect of the invention, a shade guide is provided. The shade guide may be used to set the length of a flexible stylus of a tool used by an artist to produce a particular shade. The shade guide may be provided on the tool or as a piece separate from the tool.

These and other features and advantages according to the present invention will be described in or will be apparent from the following detailed description of the illustrated embodiments when read in conjunction with the accompanying drawings in which corresponding components are identified by the same reference numerals.

BRIEF DESCRIPTION OF THE DRAWINGS

FIGS. 6(*h*)–6(*j*) are diagrams to which reference will be made in explaining the application of a coating to the paper in preparation of making a drawing surface in accordance with another embodiment of the present invention.

DETAILED DESCRIPTION OF THE INVENTION

Figure 1A:
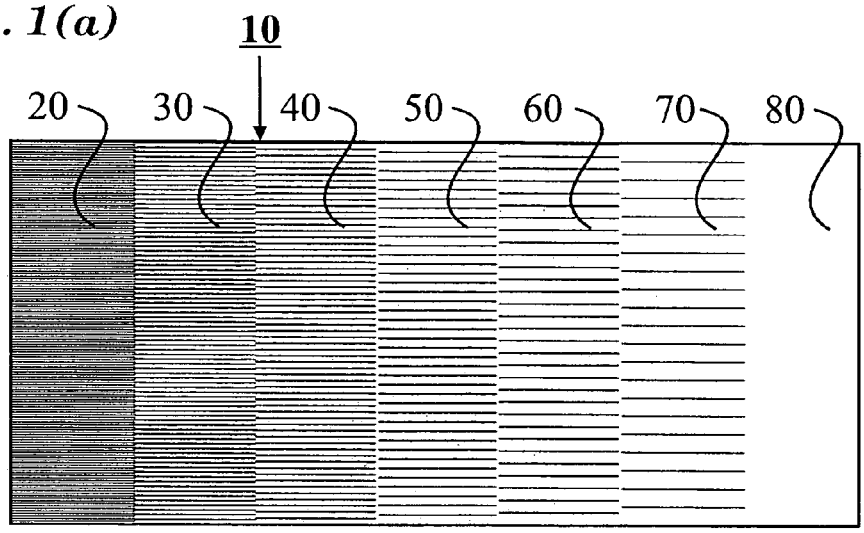
FIGS. 1(*a*) and 1(*b*) are diagrams used to illustrate the difference in gamut or range of shading obtained using materials of the present invention compared to the narrow gamut of related materials requiring enhancement.
Figure 1B:
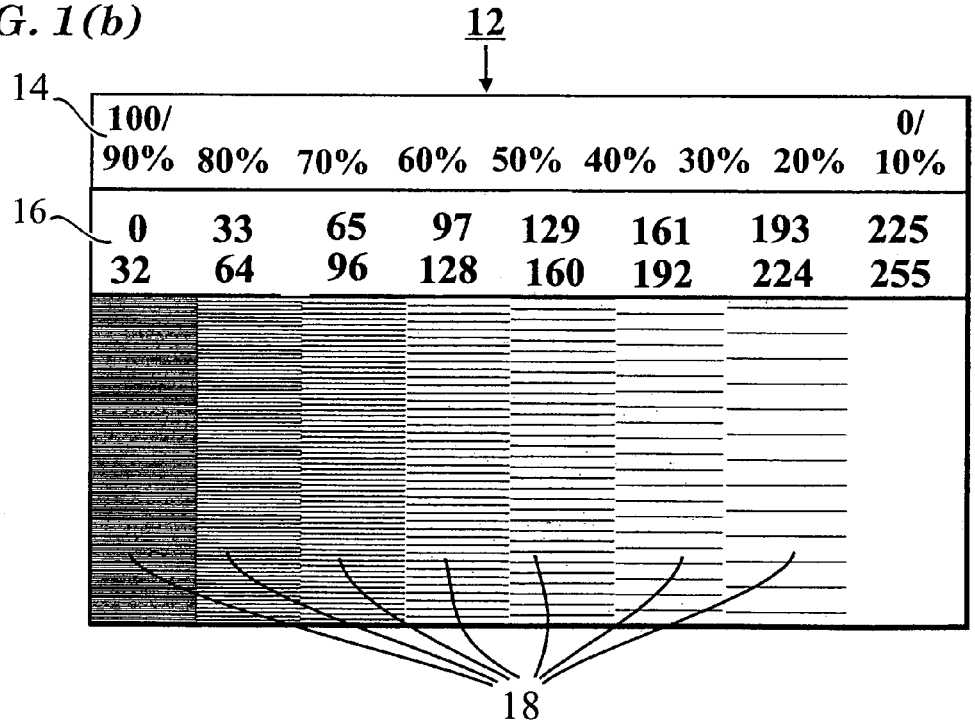

FIG. 1(*b*) is a diagram to which reference will be made in explaining the application of a detailed shading guide 12 used in conjunction with a variable length flexible stylus in the present metalpoint drawing system.

The detailed guide 12, may include a series of numbers 14 that range from 0%–100% or a series of numbers 16 that range from 0–255 printed thereon. The two series of numbers 14 and 16 may correspond to the range of tones 18 from dark to light as may be displayed on various computer graphics programs. Alternatively, the tones 18 on guide 12 may also be interpolated from a printed image such as a photograph by matching a tone from tones 18 on the guide 12 to the desired tone on the image area of the printed image.

Figure 2:
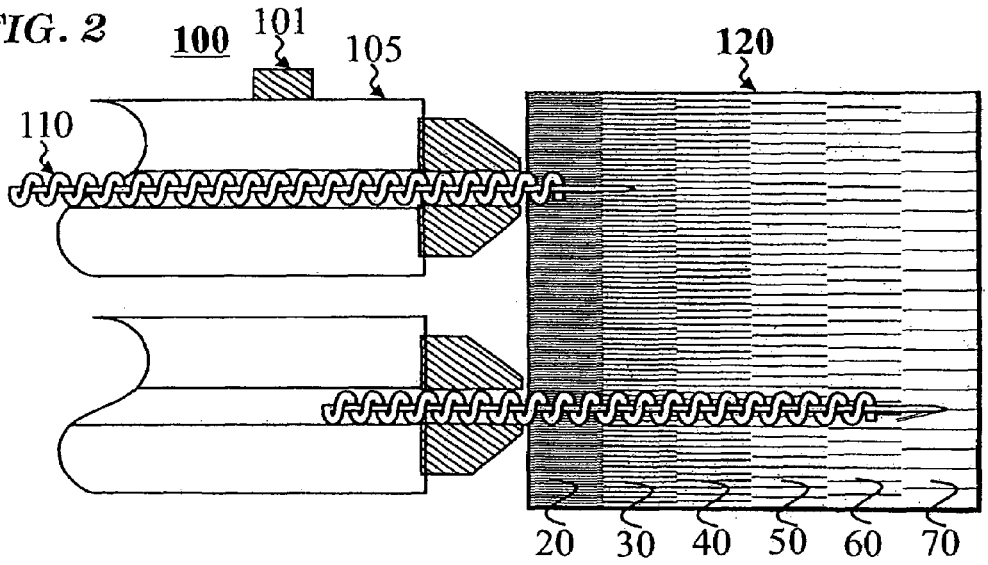
FIG. 2 is a diagram which illustrates a drawing tool and shading guide in accordance with an embodiment of the present invention.

The drawing tool 100 shown in FIG. 2 may include a holder 105, a flexible stylus 110, and a mechanism 101 for enabling an artist to vary the length of the flexible stylus 110 which is exposed from the holder. The flexible stylus 110 may be manufactured from a number of metals such as silver, gold, copper, or any other metal suitable for use in a metalpoint drawing system. The exposed portion of stylus 110 may be adjusted by the mechanism 101 to attain a desired shading according to a shading guide 120. As shown in FIG. 2, as the exposed portion increases, the intended shading becomes lighter.

Figure 3A:
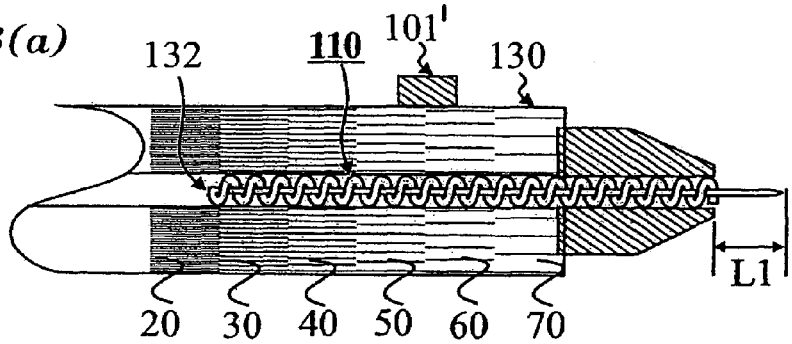
FIGS. 3(*a*) and 3(*b*) are diagrams which illustrate a drawing tool having a shading guide in accordance with another embodiment of the present invention.
Figure 3B:
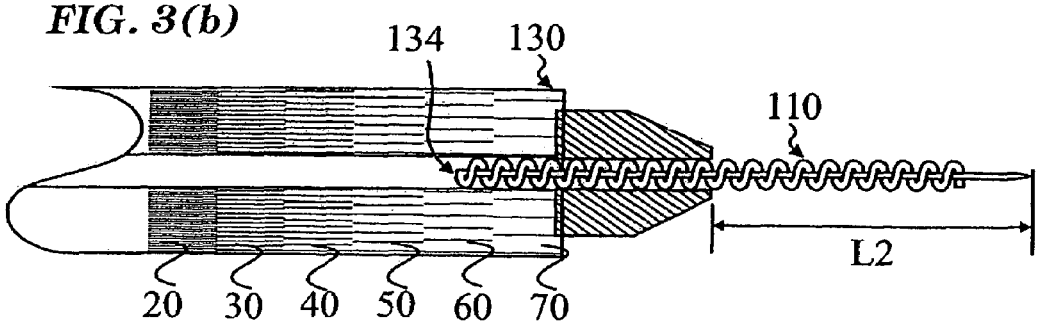
Figure 4A:
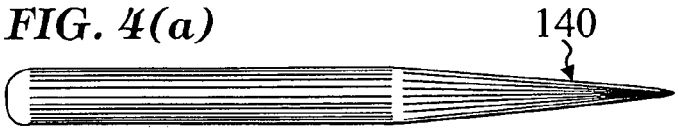
FIGS. 4(*a*)–4(*d*) are diagrams of styli usable with a holder of the drawing tool of the present invention.
Figure 4B:
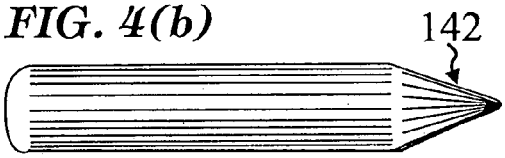
Figure 4C:
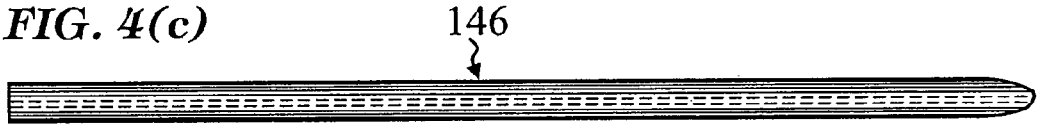
Figure 4D:
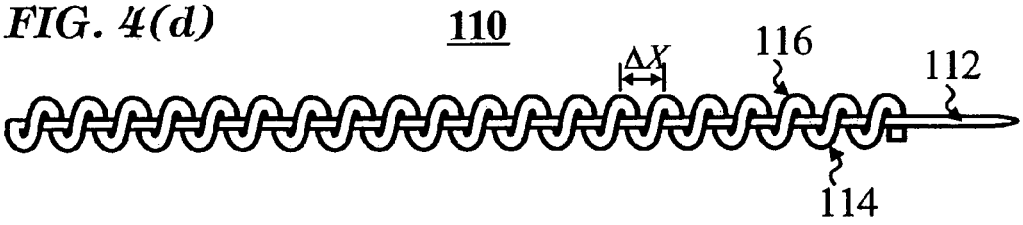
Figure 5A:
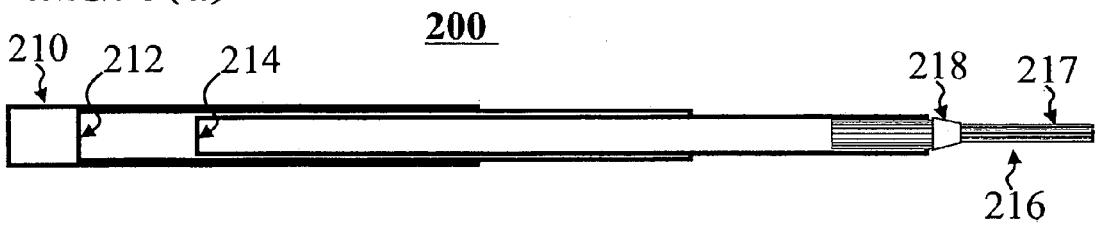
FIGS. 5(*a*)–5(*e*) are diagrams of a drawing tool and a plurality of styli usable with a holder of such drawing tool.
Figure 5B:
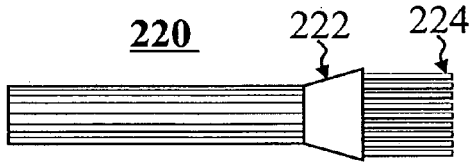
Figure 5C:
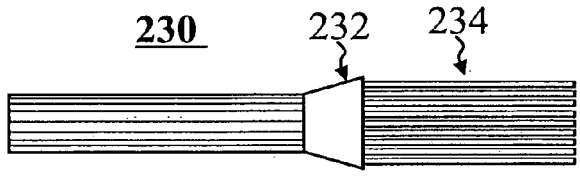
Figure 5D:
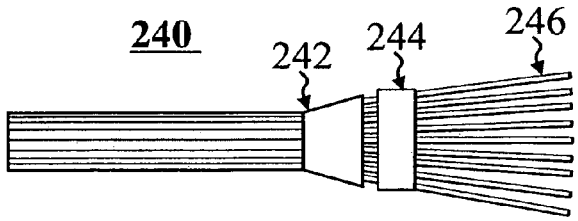
Figure 5E:
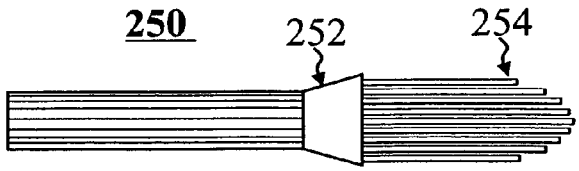
Figure 6A:
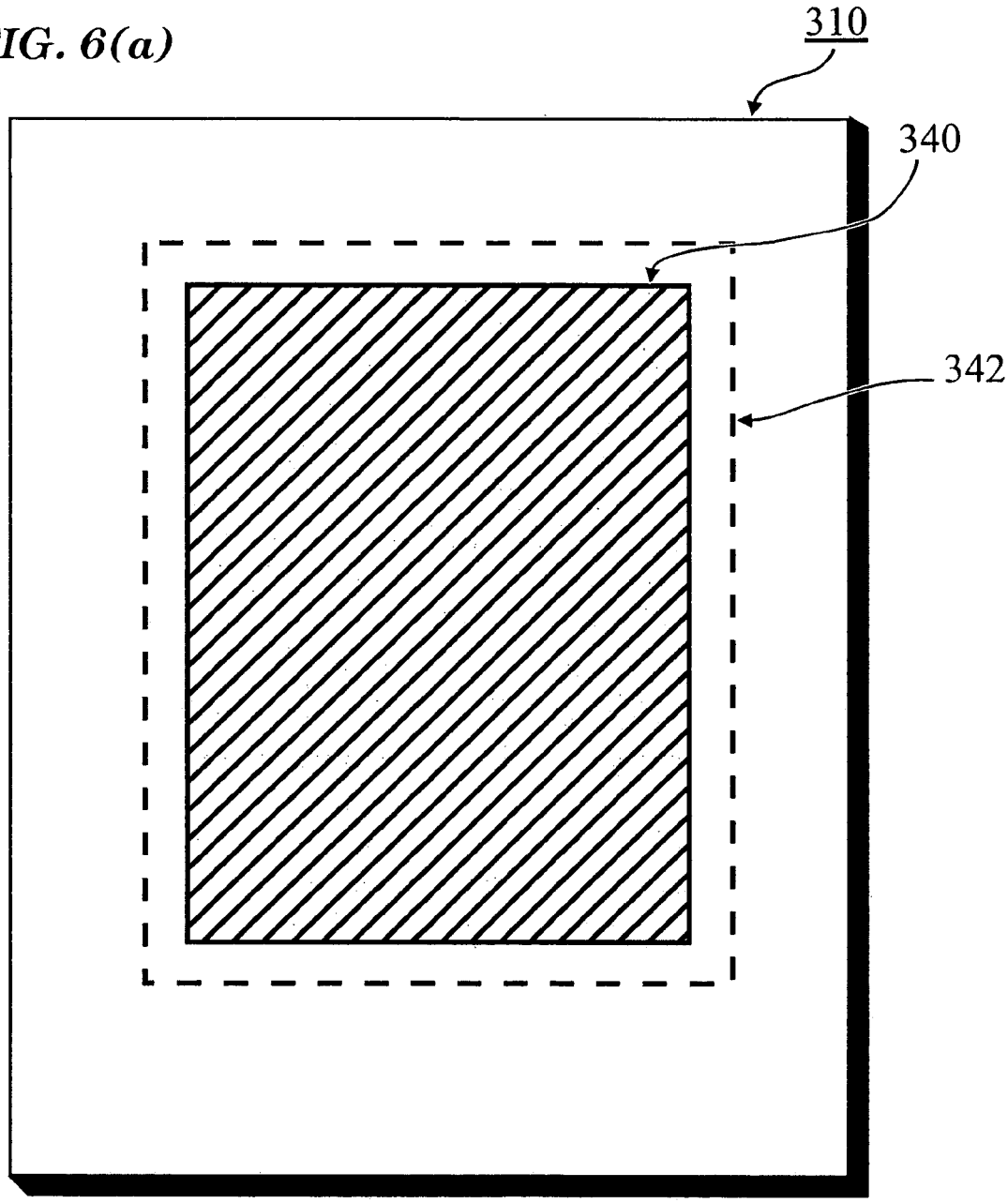
FIGS. 6(*a*)–6(*g*) are diagrams to which reference will be made in explaining the preparation of paper for making a drawing surface in accordance with another embodiment of the present invention.
Figure 6B:
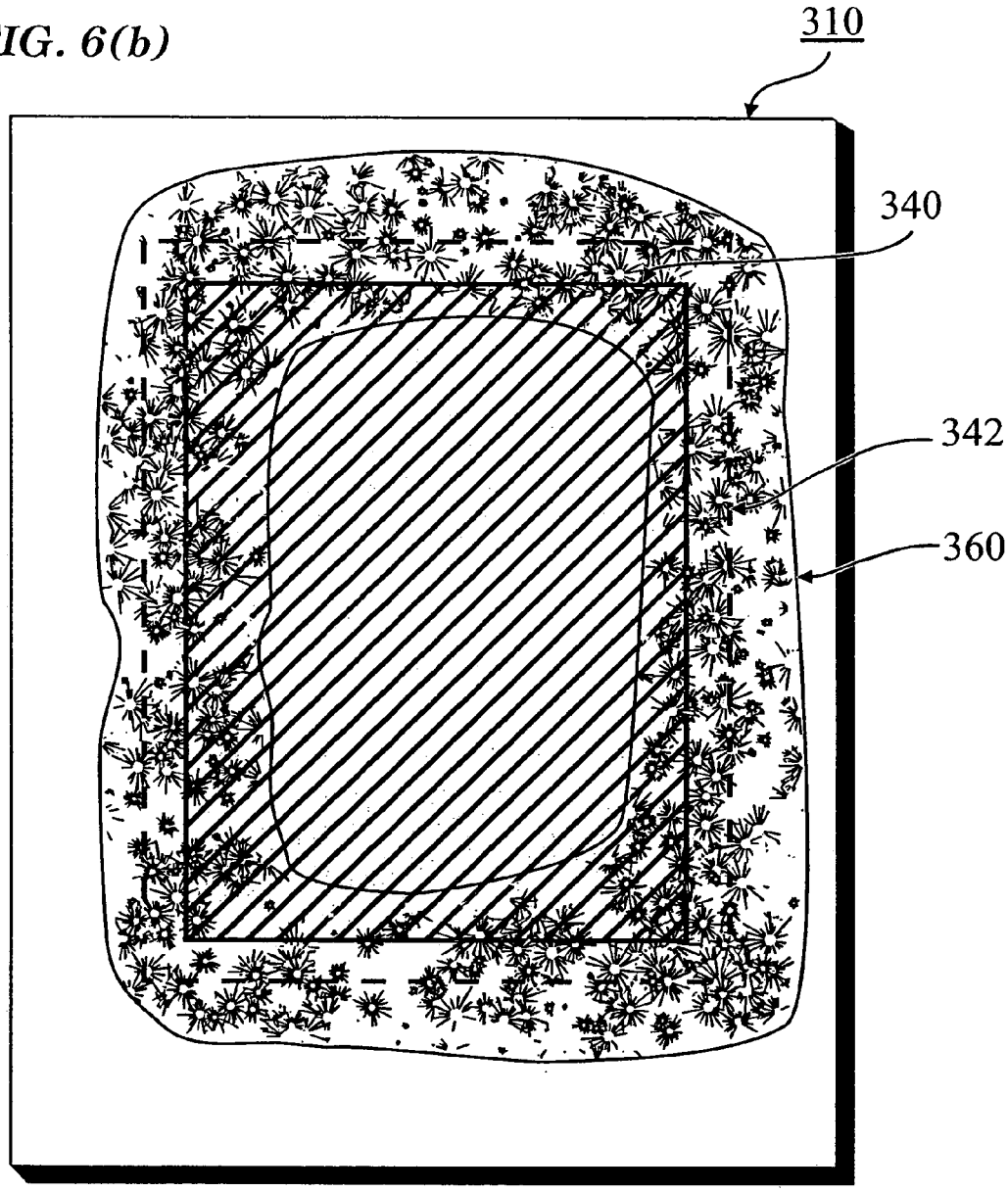
Figure 6C:
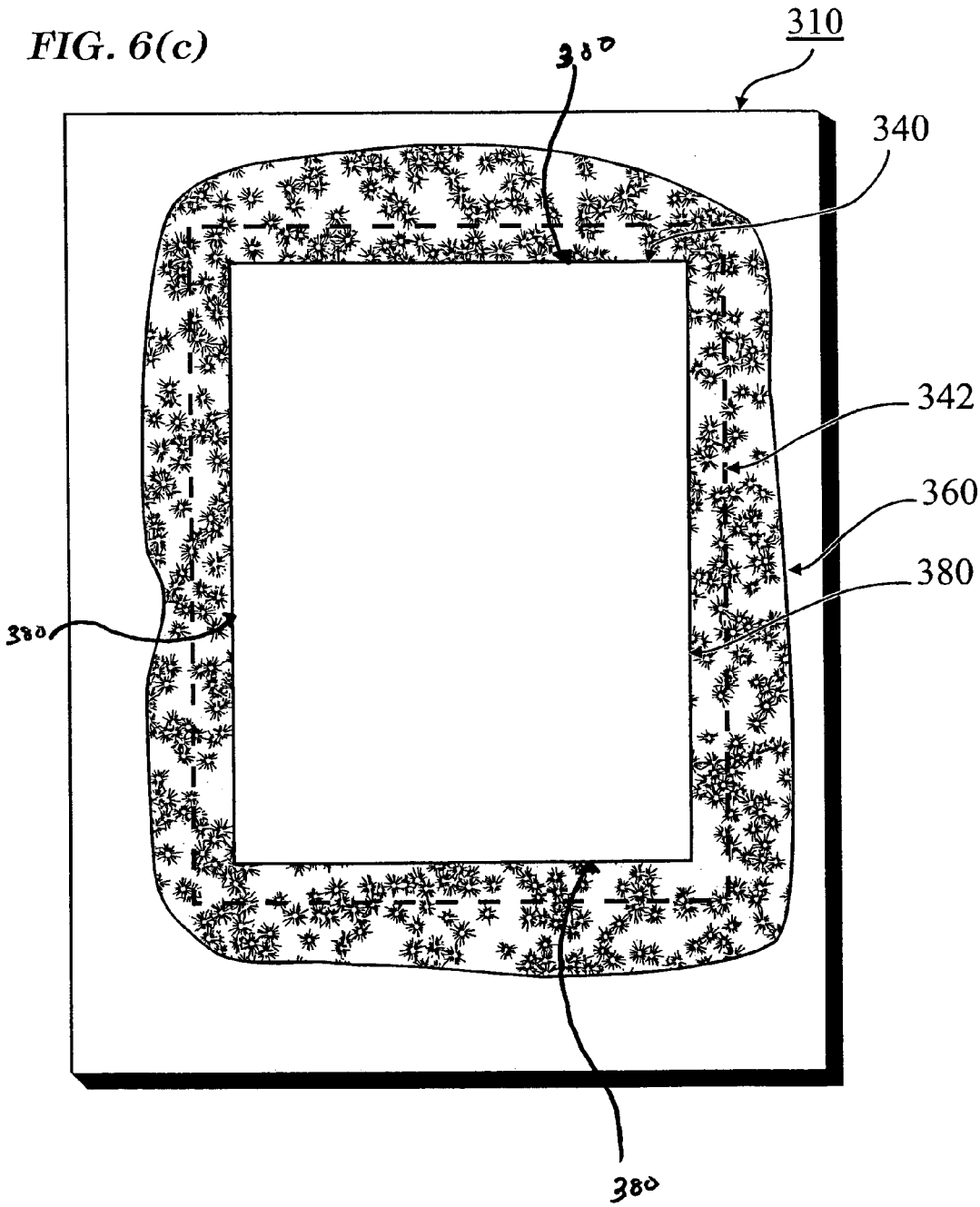
Figure 6D:
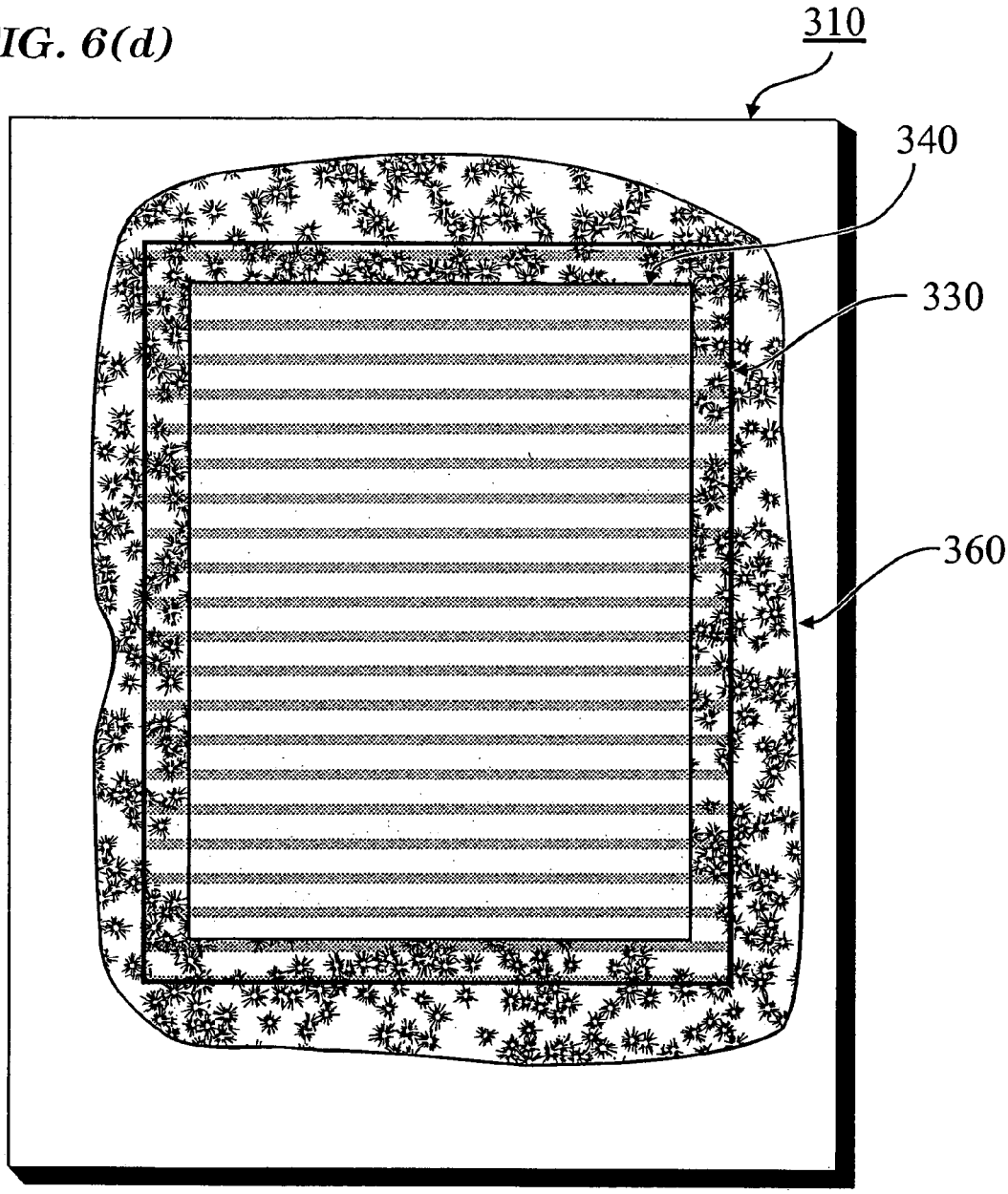
Figure 6E:
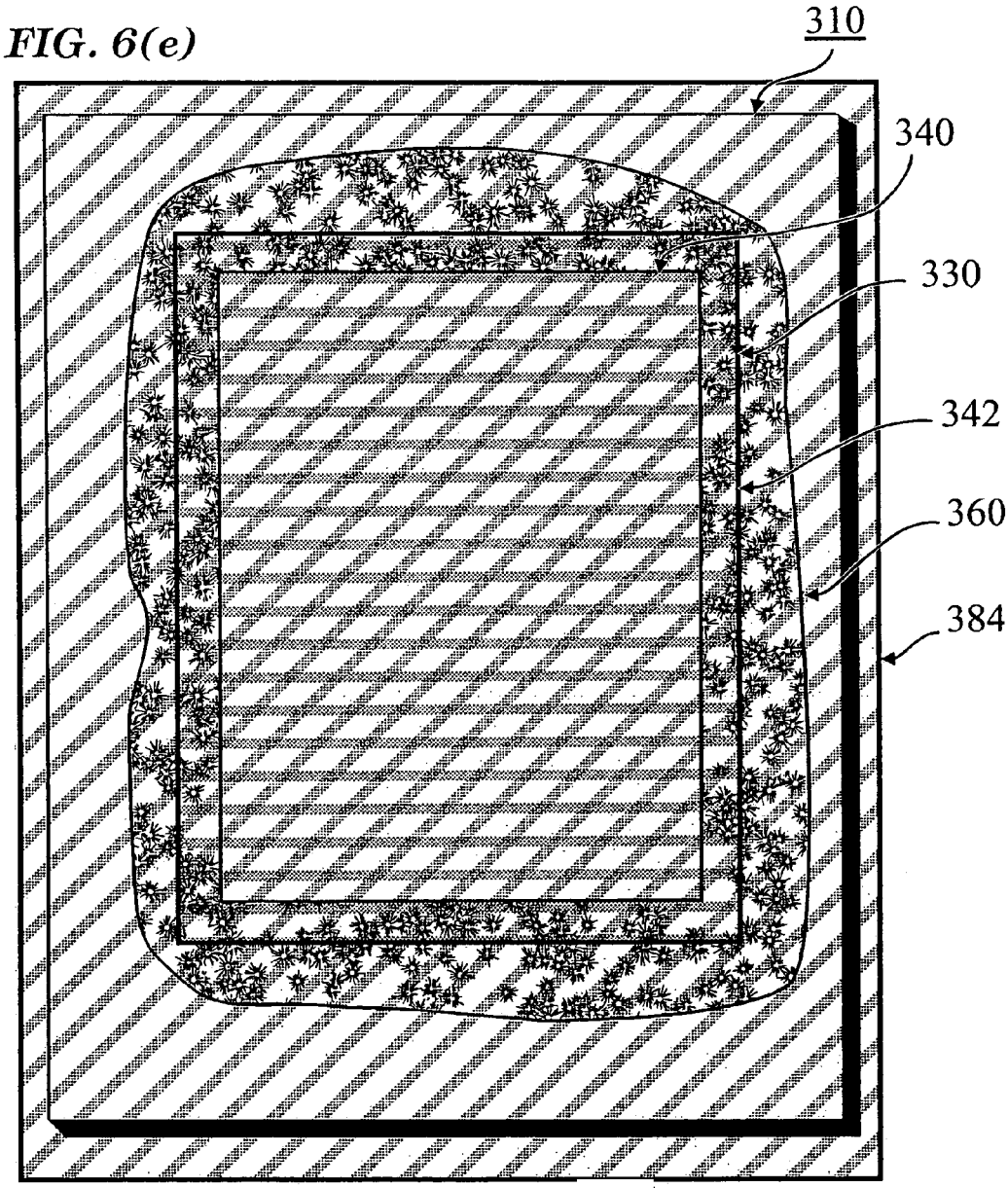
Figure 6F:
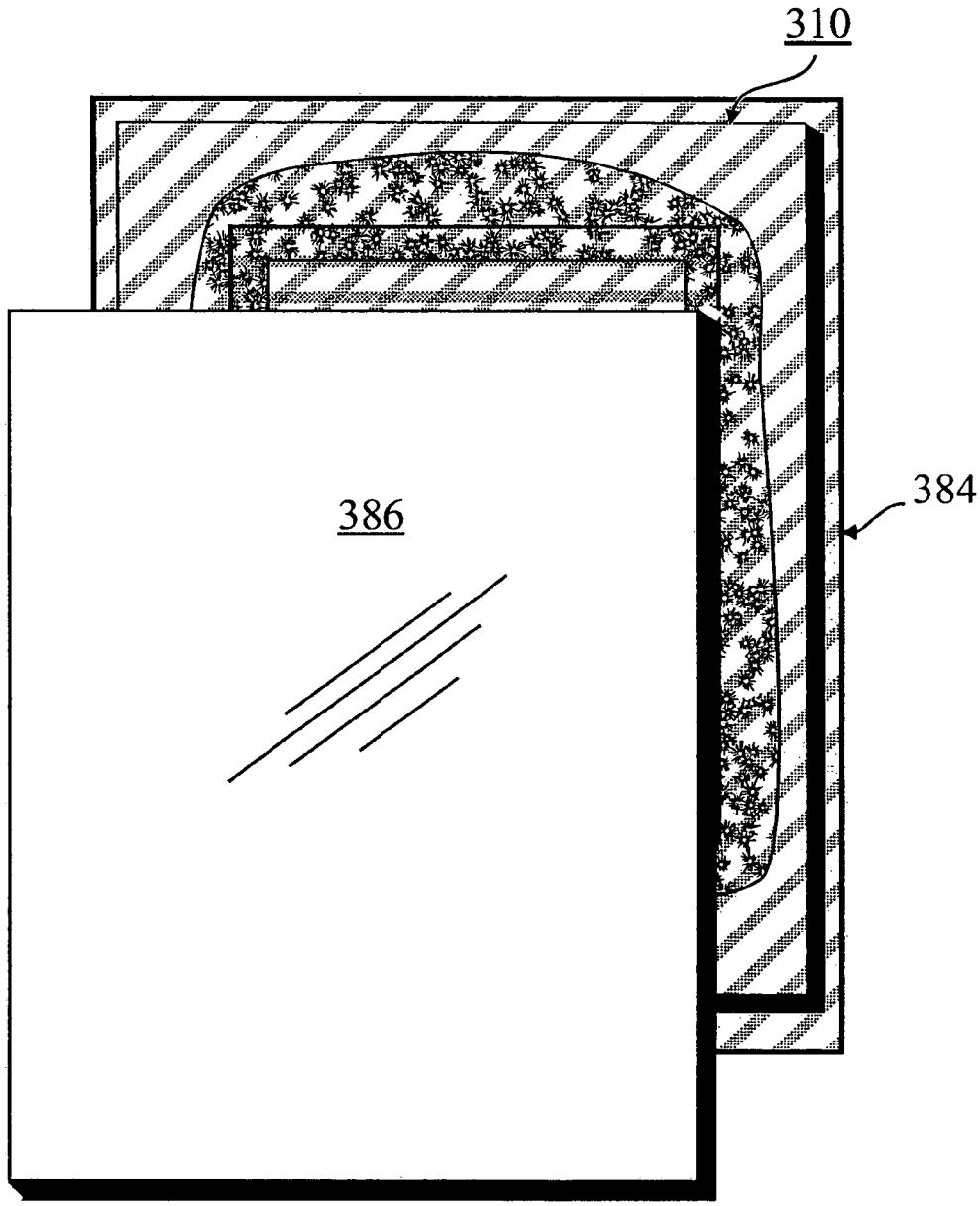
Figure 6G:
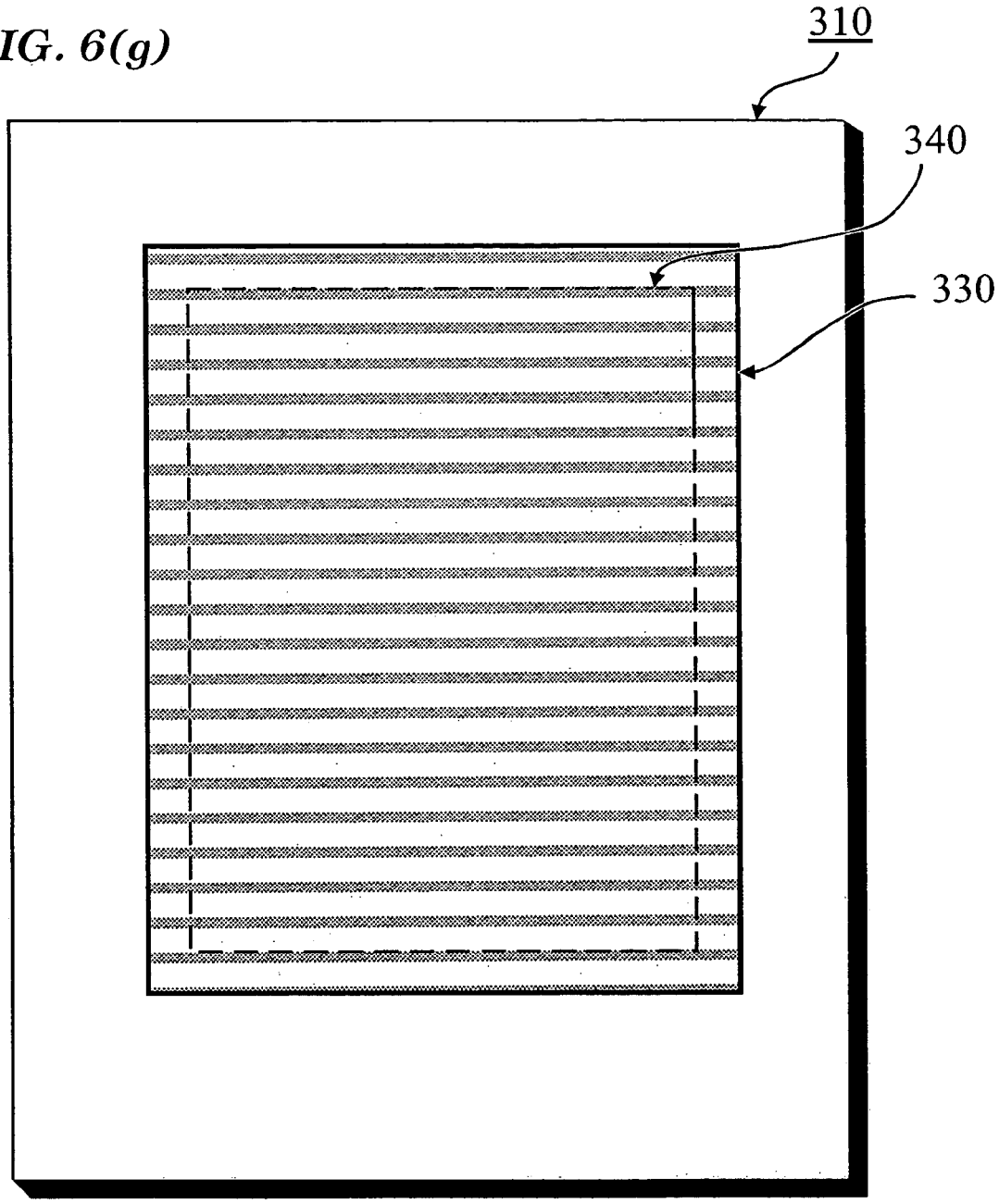
Figure 6H:
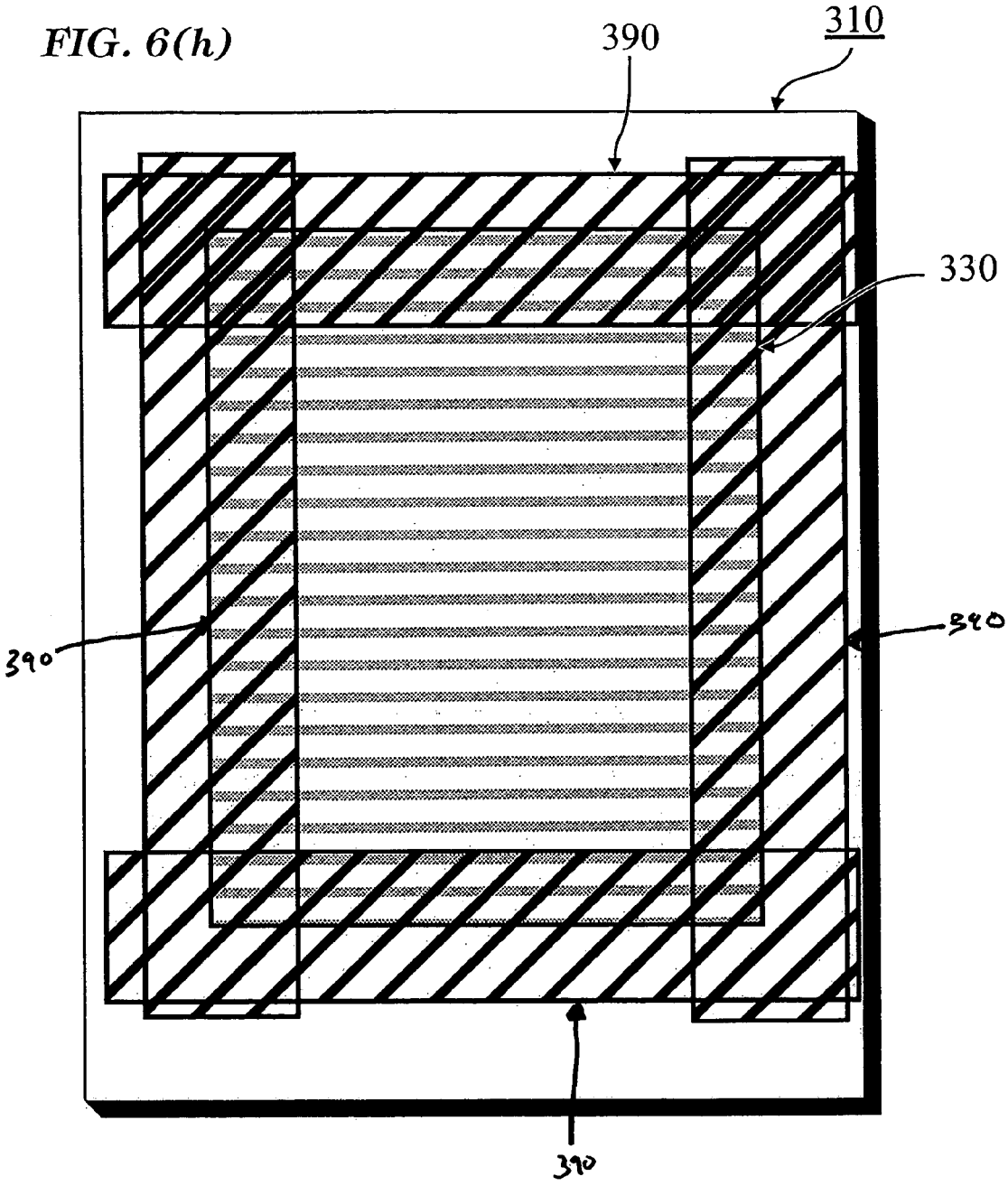
Figure 6I:
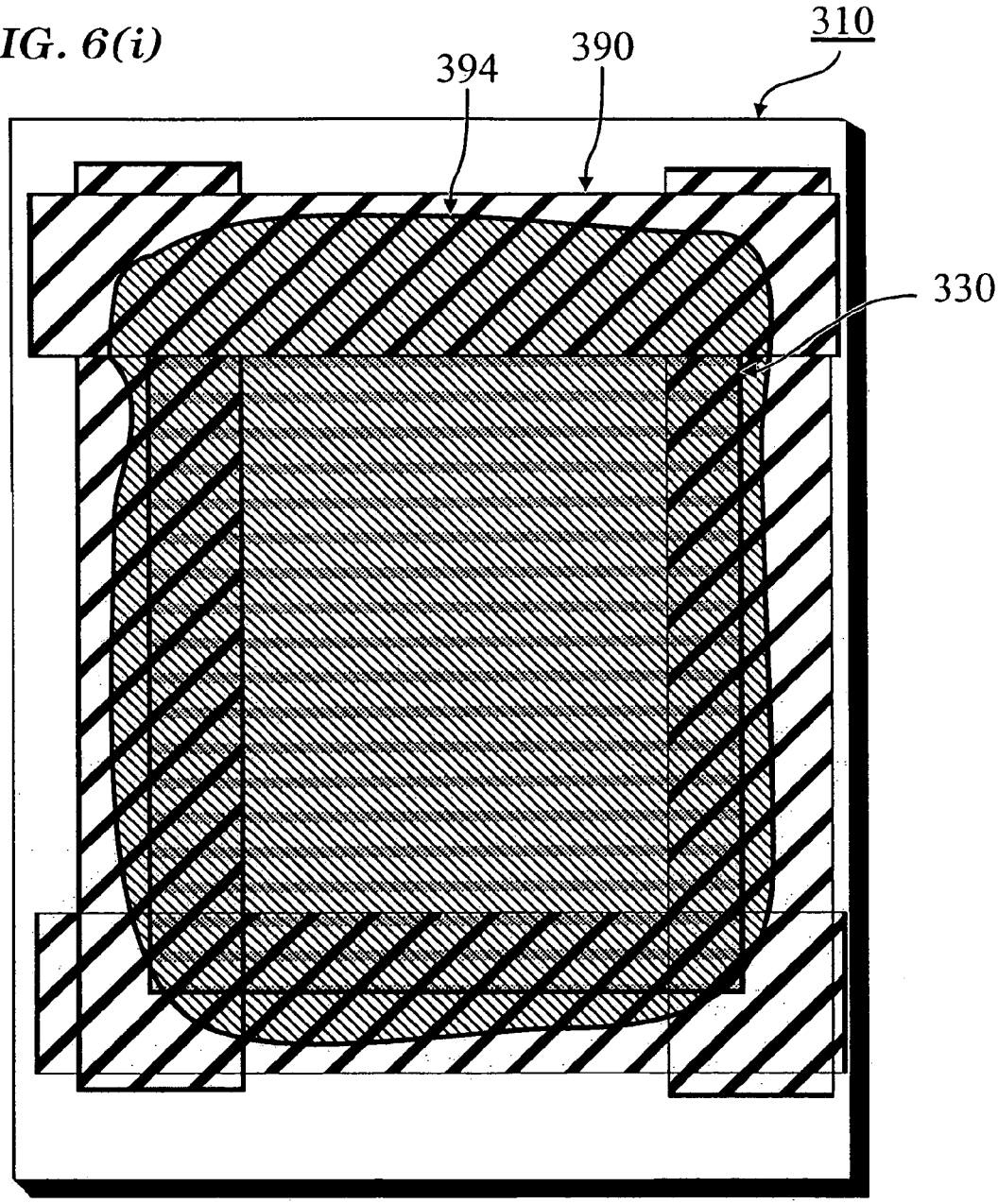
Figure 6J:
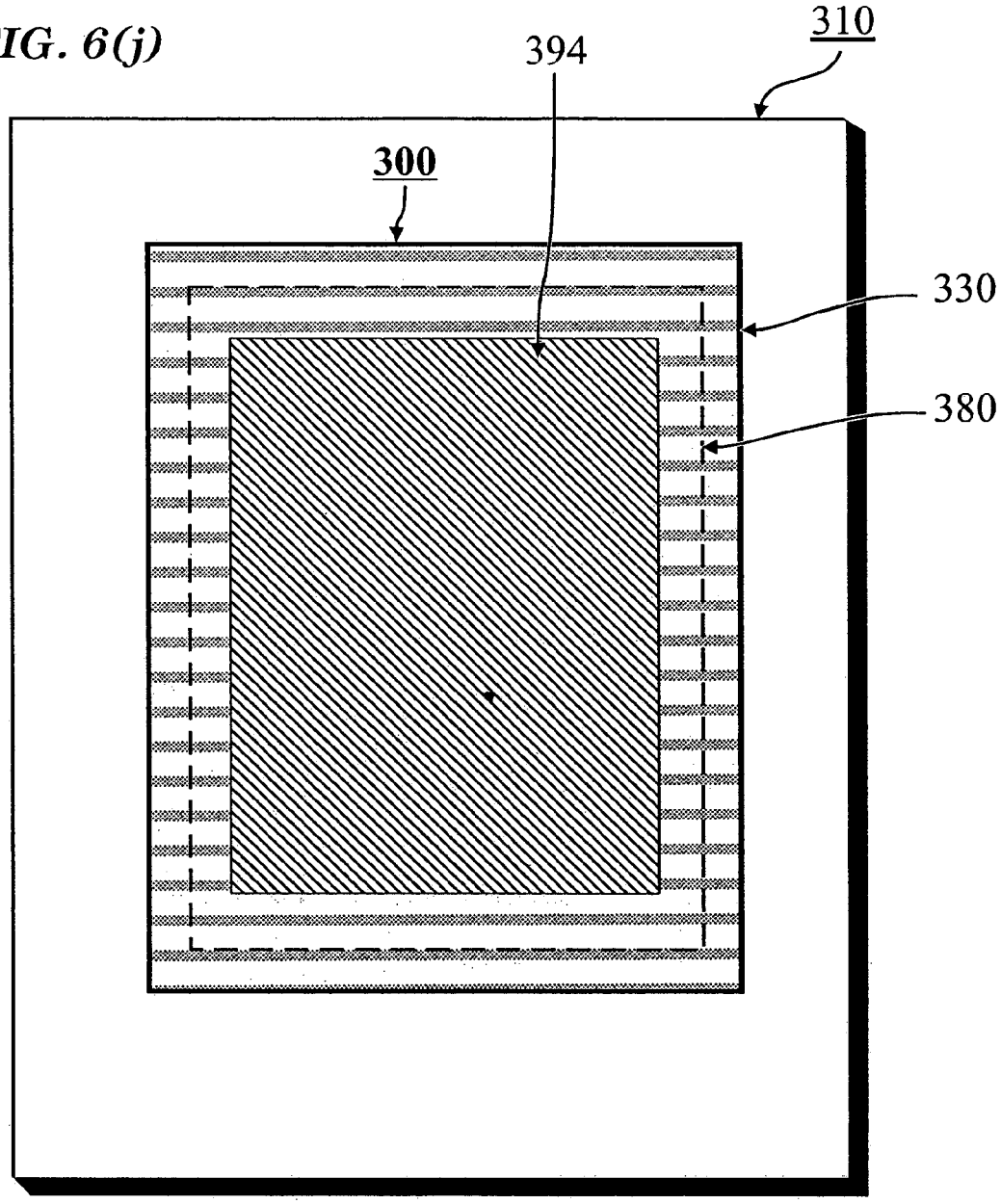

Once a particular tonal value is determined, the artist may then set the length of the flexible stylus 110 to the appropriate value as shown in FIG. 2, FIG. 3(*a*), FIG. 3(*b*) by exposing the appropriate length of the stylus to the desired value by use of the mechanism 101. The mechanism 101 may include a pressable button or the like which when pressed by the artist causes the holder 105 to release its hold on the flexible stylus 110 to enable the artist to manually adjust the length thereof. Alternatively, when pressed, the button or the like of the mechanism 101 may cause the flexible stylus 110 to advance (or retreat) by a predetermined amount. In this later situation, the artist would simply press on the button a number of times until the exposed portion of the stylus 110 was at the desired length.

The length of the exposed portion of stylus 110 determines the amount of pressure on the tip of the stylus. As the length increases, the pressure at the tip decreases and conversely as the length decreases, the pressure at the tip increases. A lower pressure at the tip yields a fainter shade on a drawing surface, whereas a greater pressure at the tip yields a darker shade. The relationship between the length of the stylus and the shade may be expressed as the value of shading being a function of the length of a flexible stylus as it applies to a particular flexible stylus, ground and substrate.

In an alternative embodiment, and as shown in FIGS. 3(*a*) and 3(*b*), a shading guide 130 may be disposed on a handle 130 of the drawing tool. The handle may be transparent in order to determine the proper length needed to attain a desired shading. For instance, in FIG. 3(*a*), the back end of stylus 132 can be seen in the area corresponding to the darker shading region (20). As such, when the stylus is exposed by use of mechanism 101' for a length $L_1$, a darker line may be drawn. On the other hand, FIG. 3(*b*) shows the back end of stylus 134 in the area corresponding to a lighter region (60). In this situation, when the stylus is exposed for a length $L_2$, a lighter line results. The mechanism 101' may be the same as or similar to mechanism 101.

FIGS. 4(*a*)–4(*b*) show a plurality of styli that may be used with a holder of a drawing tool. Styli 140 and 142 of FIGS. 4(*a*) and 4(*b*) are rigid styli whose cross-sectional diameters are each greater than 0.020 inch (0.51 mm). Stylus 140 has a smaller diameter but a longer tip as compared to stylus 142. Stylus 146 of FIG. 4(*c*) is longer and more flexible than either of the two previous styli. Preferably, the stylus of FIG. 4(*c*) has a cross-sectional diameter of 0.020 inch (0.51 mm) so that the stylus may maintain a degree of flexibility in order to produce a wide range of gamuts as shown in FIGS. 1(*a*) and 1(*b*). FIG. 4(*d*) depicts stylus 110 suitable for use in a preferred embodiment of the present invention. Stylus 110 may be manufactured as a single, elongated piece of metal having two portions. A first portion or rod 112 extends in a direction parallel to the holder of a drawing tool. The second portion or coil 114 coils around the rod 112. Coil 114 may provide radial support to the rod 112. Ridges 116 in coil 114 are separated by a distance $\Delta x$. Such ridges 116 may provide an indication as to the shade that will be produced on a drawing surface. The more exposed ridges, the lighter the shade will be. Although it may be preferable for rod 110 to have a cross-sectional diameter of approximately 0.010 inch (0.27 mm), rod 110 may have a cross-sectional diameter ranging in between 0.010 inch (0.27 mm) to 0.020 inch (0.5 mm).

FIGS. 5(*a*)–5(*e*) depict yet another embodiment of the present invention. FIG. 5(*a*) illustrates a telescopic holder or drawing tool 200 which may have a base portion 210 and two additional portions 212 and 214 that may be extended further. At the end of the telescopic holder 200, there may be a stylus 216 having a number of metal wire strands 217. A ferrule 218 may hold the strands 217 in place. FIGS. 5(*b*)–5(*e*) depict other examples of styli with wire strands. Stylus 220 (see FIG. 5(*b*)) has a number of short wire strands 224 held together by ferrule 222. Stylus 230 (see FIG. 5(*c*)) has a number of long wire strands 234 held together by ferrule 232. Stylus 240 (see FIG. 5(*d*)) has a number of wire strands 246 held together by ferrule 242. Collar 244 may adjust the breadth of strands 246 to achieve a desired effect. Stylus 250 (see FIG. 5(*e*)) has a number of strands 254 with different lengths that are held together by ferrule 252.

The process of preparing a drawing surface will be described herein below while making reference to FIGS. 6(*a*) through 6(*j*). The process may begin with a rigid board 310, such as masonite, as shown in FIG. 6(*a*). A mask 340 may be applied to board 310 within a perimeter 342 of a drawing surface area.

As shown in FIG. 6(*b*), an adhesive 360 (FIG. 6*b*), such as glue, may be applied on the edges of mask 340 extending beyond the perimeter 342 of the outside of the drawing surface area.

As shown in FIG. 6(*c*), while the adhesive 360 is still wet, the mask 340 may be removed, creating four straight edges 380 of wet adhesive.

As shown in FIG. 6(*d*), a paper 330, such as a sheet of translucent paper, may be placed on the wet adhesive area 360 to affix the paper 330 to board 310. Preferably, the sheet of paper has a transparency of 29%, although the transparency may be equal to or less than approximately 50%. In addition, the paper 330 may have a smoothness in the range of approximately 10 to 35 sheffields and a tear growth in the range of approximately 1750 to 2350 mNm/m.

As shown in FIG. 6(*e*), after paper 330 is placed on top of adhesive area 360, wax paper 384 may be placed on top covering paper 330 and board 310. The excess adhesive is squeegeed out by applying pressure over the surface of the wax paper.

As shown in FIG. 6(*f*), another masonite board 386 is placed on top. The two masonite boards 310 and 386 are clamped together until the adhesive has dried.

As shown in FIG. 6(*g*), after the boards 310 and 386 are unclamped, and the wax paper 384 is removed, the paper 330 is ready to be coated.

Coating steps are illustrated in FIG. 6(*h*), FIG. (6)*i*, and FIG. 6(*j*). Paper 330 may be coated with a coating substance or ground 394, such as a correction fluid or a diluted version thereof, gesso, or Chinese white, or any other suitable ground material that may be abrasive to a metal stylus.

Before the ground is applied, a mask 390 (FIG. 6(*h*)) may be applied on top of paper 330. The mask 390 is intended to leave a clear border on the paper 330 which may prevent paper 330 from curling at the edges when the ground has dried.

As shown in FIG. 6(*i*) the board 310 may be leveled in order to prevent the ground from unnecessarily spreading. The ground 394 may be poured at one end of the board 310 and carried across the surface of the paper 330 using a spatula with a soft plastic blade. The ground 394 applied to paper 330 may be white or may have a number of different tints. Such tints may be achieved by mixing the correction fluid with other materials such as Gouache, paints, etc.

As shown in FIG. 6(*j*), after the ground 394 is dried, the border mask 390 may be removed, whereupon and the drawing surface 300 is ready to be drawn upon by a drawing tool.

It will be appreciated that the present invention is not limited to the above-described descriptions and maybe applicable to other forms of metalpoint drawing systems.

For instance, the coated paper 300 may be drawn on while adhered to board 310 or it may be removed from board 310 by cutting within the boundaries set forth by adhesive area 380 and affixed to an alternate backing such as a foam core or an illustration board.

Although preferred embodiments of the present invention and modifications thereof have been described in detail herein, it is to be understood that this invention is not limited to those precise embodiments and modifications, and that other modifications and variations may be effected by one skilled in the art without departing from the spirit and scope of the invention as defined by the appended claims.

What is claimed is:

1. A tool for use by an artist for creating a metalpoint drawing on a prepared drawing surface, said tool comprising:

a shade guide, wherein said shade guide comprises a series of tones ranging from dark to light which provide an indication to an artist of a shade producible by a length of a flexible metal stylus exposed from an end of a stylus holder; a stylus holder, wherein said shade guide is affixed to said stylus holder, wherein said stylus holder includes means for enabling an artist to reciprocally vary the length of an exposed portion of a flexible metal stylus from an end of said stylus holder; and a variable length flexible metal stylus held by said stylus holder.

2. The tool according to claim 1, wherein said flexible metal stylus includes a plurality of strands of metal.

3. The tool according to claim 2, wherein said strands of metal are fabricated from a silver-type metal.

4. The tool according to claim 1, wherein said flexible metal stylus is fabricated from a silver-type metal.

5. A metalpoint drawing system comprising:

a drawing surface having a sheet of translucent paper with a coating substance applied thereto; and a tool for use by an artist for creating a metalpoint drawing on said drawing surface, said tool comprising a shade guide, wherein said shade guide comprises a series of tones ranging from dark to light which provide an indication to an artist of a shade producible by a length of a flexible metal stylus exposed from an end of a stylus holder; a stylus holder, wherein said shade guide is affixed to said stylus holder, wherein said stylus holder includes means for enabling an artist to reciprocally vary the length of an exposed portion of a flexible metal stylus from an end of said stylus holder; and a variable length flexible metal stylus held by said stylus holder.

6. The system according to claim 5, wherein said coating substance is a correction fluid.

7. The system according to claim 6, wherein said translucent paper has a transparency of less than 50%.

8. The system according to claim 6, wherein said translucent paper has a transparency of approximately 29%.

9. The system according to claim 6, wherein said translucent paper has a smoothness in the range of approximately 10 to 35 sheffields.

10. The system according to claim 6, wherein said translucent paper has a tear growth in the range of approximately 1750 to 2350 mNm/m.

11. The system according to claim 5, wherein said flexible metal stylus includes a plurality of strands of metal.

12. The system according to claim 11, wherein said strands of metal are fabricated from a silver-type metal.

13. The system according to claim 5, wherein said flexible metal stylus is fabricated from a silver-type metal.

14. A method for creating a metalpoint design comprising the steps of:

providing a tool, wherein said tool comprises a shade guide, wherein said shade guide comprises a series of tones ranging from dark to light which provide an indication to an artist of a shade producible by a length of a flexible metal stylus exposed from an end of a stylus holder; a stylus holder, wherein said shade guide is affixed to said stylus holder, wherein said stylus holder includes means for enabling an artist to reciprocally vary the length of an exposed portion of a flexible metal stylus from an end of said stylus holder; and a variable length flexible metal stylus held by said stylus holder affixing a translucent paper to a holding member; and applying a coating substance on said translucent paper for abrading said flexible metal stylus, drawing said tool and flexible metal stylus across said coated translucent paper and abrading said flexible metal stylus.

15. The method according to claim 14, wherein said coating substance is a correction fluid.

16. The method according to claim 15, wherein said translucent paper has a transparency of less than 50%.

17. The method according to claim 15, wherein said translucent paper has a transparency of approximately 29%.

18. The method according to claim 15, wherein said translucent paper has a smoothness in the range of approximately 10 to 35 sheffields.

19. The method according to claim 15, wherein said translucent paper has a tear growth in the range of approximately 1750 to 2350 mNm/m.

20. A shading guide for use by an artist using a flexible metal stylus in a metalpoint drawing, said shade guide comprising a series of tones ranging from dark to light which provide an indication to an artist of a shade producible by a length of a flexible metal stylus exposed from an end of a stylus holder; a stylus holder, wherein said shade guide is affixed to said stylus holder, wherein said stylus holder includes means for enabling an artist to reciprocally vary the length of an exposed portion of a flexible metal stylus from an end of said stylus holder; and a variable length flexible metal stylus held by said stylus holder.

* * * * *